US007685739B2

(12) United States Patent
Aveni et al.

(10) Patent No.: US 7,685,739 B2
(45) Date of Patent: Mar. 30, 2010

(54) CONVERTIBLE DANCE SHOE

(75) Inventors: Michael A. Aveni, Lake Oswego, OR (US); Cassandra Dunster, Portland, OR (US); Nuria Hansen, Portland, OR (US)

(73) Assignee: Nike, Inc., Beaverton, OR (US)

( * ) Notice: Subject to any disclaimer, the term of this patent is extended or adjusted under 35 U.S.C. 154(b) by 583 days.

(21) Appl. No.: 11/278,352

(22) Filed: Mar. 31, 2006

(65) Prior Publication Data

US 2007/0227045 A1 Oct. 4, 2007

(51) Int. Cl.
*A43B 5/12* (2006.01)
*A43B 23/26* (2006.01)

(52) U.S. Cl. ..... 36/8.3; 36/54; 36/50.1; 36/100

(58) Field of Classification Search ..... 36/54, 36/50.1, 100, 8.3, 59 R
See application file for complete search history.

(56) References Cited

U.S. PATENT DOCUMENTS

| | | | | |
|---|---|---|---|---|
| 2,069,964 | A | 2/1937 | Miller | |
| 2,162,912 | A * | 6/1939 | Craver | 36/59 R |
| 2,378,461 | A * | 6/1945 | Bonyhady | 36/50.1 |
| 4,366,634 | A * | 1/1983 | Giese et al. | 36/114 |
| 4,370,818 | A | 2/1983 | Simoglou | |
| 4,805,321 | A | 2/1989 | Tonkel | |
| 4,890,398 | A * | 1/1990 | Thomasson | 36/114 |
| 4,955,150 | A | 9/1990 | Fagan | |
| 5,065,531 | A * | 11/1991 | Prestridge | 36/100 |
| 5,459,947 | A | 10/1995 | Lasher | |
| 5,659,979 | A | 8/1997 | Sileo | |
| 5,943,793 | A * | 8/1999 | Clements | 36/50.1 |
| 6,321,466 | B1 | 11/2001 | Bordin et al. | |
| 2002/0029494 | A1 | 3/2002 | Small | |
| 2002/0029496 | A1 | 3/2002 | Morle | |
| 2002/0144434 | A1 | 10/2002 | Farys et al. | |
| 2003/0056394 | A1 | 3/2003 | Yu | |
| 2004/0003516 | A1 * | 1/2004 | Jacobs | 36/50.1 |
| 2005/0102856 | A1 | 5/2005 | Jones | |

FOREIGN PATENT DOCUMENTS

WO 02-076257 A 10/2002

OTHER PUBLICATIONS

International Search Report mailed Nov. 12, 2007 in Application No. PCT/US2007/007818.
Written Opinion of the International Searching Authority mailed Nov. 12, 2007 in Application No. PCT/US2007/007818.

* cited by examiner

*Primary Examiner*—Ted Kavanaugh
(74) *Attorney, Agent, or Firm*—Banner & Witcoff, Ltd.

(57) ABSTRACT

An article of footwear having a street shoe configuration and a dance shoe configuration is provided. The shoe includes a sole and an upper having a lacing system, lace and a tongue. The tongue is removably attached to the upper. The tongue may be removed to convert the shoe from a street shoe configuration to a dance shoe configuration. The tongue may also be secured via a lace strung through an apertures formed in the tongue. This configuration provides for easier conversion from street shoe to dance shoe.

14 Claims, 10 Drawing Sheets

CONVERTIBLE DANCE SHOE

TECHNICAL FIELD

This invention relates generally to an article of footwear. More particularly, this invention relates to a shoe having a removable tongue and to a shoe that is configured to be used as a street shoe and can be converted to use as a dance shoe.

BACKGROUND

Articles of footwear, in particular, athletic shoes, can be thought of as having two major components, an upper and a sole. The upper is secured to the sole and provides a cavity for receiving a foot. The upper is generally formed from multiple elements stitched or adhesively bonded together to form a structure for comfortably receiving a foot. In addition, the upper also includes a lacing system which, when loosened can allow the cavity for receiving the foot to expand to permit feet of varying sizes to fit into the cavity. The lacing system can then be secured to pull the upper in to surround the foot and secure the shoe to the foot. A tongue portion, covering the top of the foot and extending under the lacing system may also be included. The tongue is stitched to the upper and enhances the comfort of the shoe.

The sole is the interface between the foot and the ground and is intended to provide traction, support and cushioning for the user. Many soles have a multi-part construction including an outsole and a midsole. The outsole is generally designed for durability and traction. The midsole is commonly designed to absorb the force created as the shoe contacts the ground. The sole may be flexible to cater to the intended purpose of the shoe. For example, shoes made particularly for use in dancing or dance-related activities may include a flexible sole to allow for various dance or dance-related foot movements. A wearer of conventional street shoes must change to dance shoes to go from the street to the dance studio.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Aspects of the convertible dance shoe relate to an article of footwear that can be converted from a street shoe to a dance shoe. In one arrangement, the tongue of the shoe is removably attached to the upper. To convert the street shoe to a dance shoe, the tongue is removed and the lace may be removed. To maintain the appearance of a dance shoe, a ribbon may be strung through the lacing system in place of the lace.

Other aspects relate to an article of footwear having a partially floating or removable tongue. In another arrangement, the tongue may be connected via the lace such that it is free floating within the upper. In one example, the tongue is removed from the upper, however a lace can be strung through a slot in the tongue. The tongue is secured in place by the lace as it is tightened around the foot of the user.

DETAILED DESCRIPTION OF THE DRAWINGS

Figure 1A:
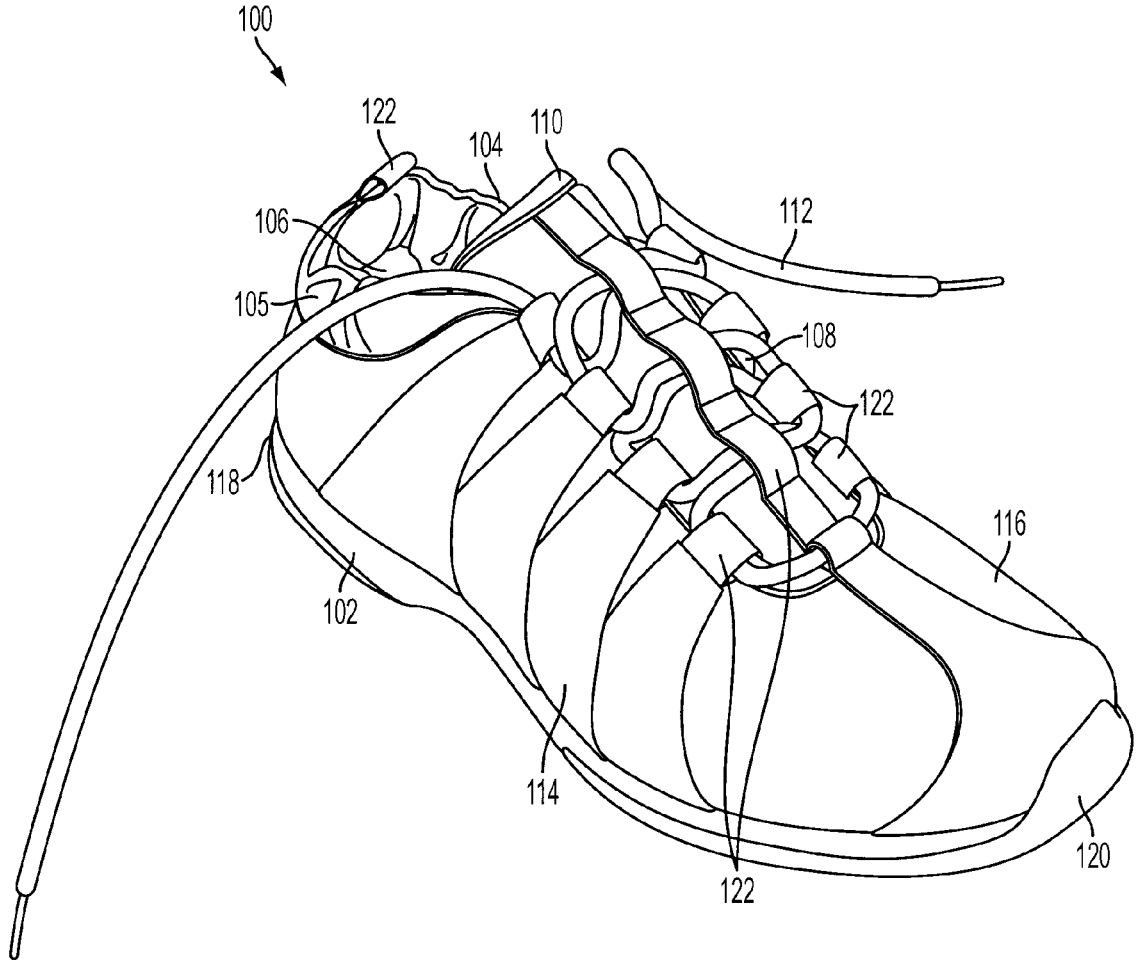
FIG. 1A is a perspective view of a shoe according to aspects of the arrangement of the convertible dance shoe.

One arrangement showing aspects of the convertible dance shoe is the shoe 100 of FIGS. 1A-5. The shoe 100 of FIGS. 1A-5 generally includes a sole 102 including a midsole and an outsole, as well as an upper 104. The upper 104 generally forms a cavity 106 into which the foot of the user is inserted. In addition, the upper 104 can include a lacing system 108, as well as a tongue portion 110. The tongue 110 of the shoe 100 may be removed to allow the shoe 100 to be used as a dance shoe, or in dance-related activities in which the appearance of a dance shoe is desirable. In addition, the lace 112 used in the shoe 100, when configured as a street shoe, may be removed to allow a dance ribbon to be strung through the lacing system 108 to enhance the appearance of a dance shoe.

FIG. 1A depicts a shoe 100 according to aspects of the convertible dance shoe. As seen in FIG. 1A, the shoe 100 has the appearance of a street shoe. The shoe 100 includes an upper 104 and a sole 102. The upper 104 can be formed from various material elements that are stitched and/or adhesively bonded together to form an interior void or cavity 106 which comfortably receives a user's foot and secures the position of the foot relative to the sole 102. In addition, the upper can include an elastic ankle support 105 that surrounds a portion of the wearer's ankle. This elastic aids in providing a secure fit for the shoe. It also may add to the dance shoe appearance that is desired. The sole 102 is secured to a lower portion of the upper 104 and provides a durable, weather-resistant surface for providing traction, support and comfort to the user.

The upper 104 and sole 102 generally work together to flex, stretch or otherwise move to accommodate the movement of the user's foot while providing support and comfort. For instance, great flexibility may be desired in a dance shoe to provide for certain movements or positions of the foot. The upper 104 and sole 102 of a dance shoe can have great flexibility to accommodate a substantial bend, such as when a dancer curls the bottom of her foot.

Figure 1B:
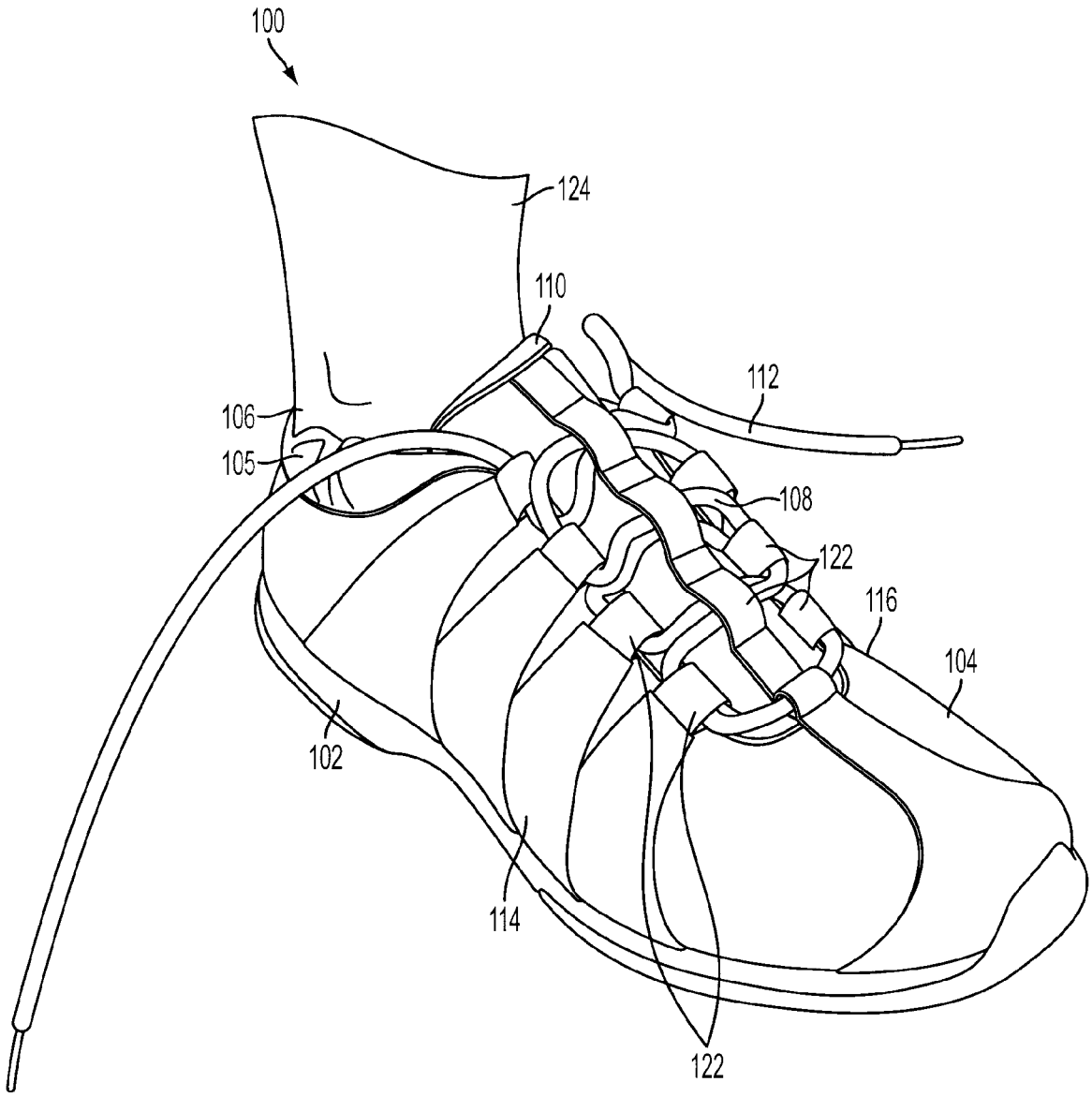
FIG. 1B is a perspective view of the shoe of FIG. 1A, but with the foot of the user inserted into the shoe.

As shown in FIGS. 1A and 1B, the various materials forming the upper 104 combine to form a structure having a lateral side 114, an opposite medial side 116, a tongue 110 and an interior boot that form the cavity 106 within the upper 104 into which a user's foot is inserted. In addition, the upper 104 includes a lacing system 108 configured to secure the shoe 100 to the user's foot. The lateral side 114 extends from the back of the shoe 100, or heel portion 118, to the front of the shoe 100, or toe portion 120. The lateral side 114 is generally configured to contact and cover a lateral portion of the user's foot. As shown in FIG. 1A, the lateral side 114, medial side 116 and tongue 110 cooperatively form an ankle opening in the heel region 118 to provide the user's foot with access to the cavity 106 within the upper 104. FIG. 1B shows the shoe 100 with the user's foot inserted into the cavity 106.

The tongue 110 extends longitudinally along the upper 104 and is positioned to contact the instep area of the foot. A portion of the tongue 110 is removably secured to an interior surface of the upper 104 via an attachment feature (not shown). For instance, the tongue 110 can be removably attached to the lateral 114 and medial 116 sides of the upper 104 using an attachment feature such as a hook and loop closure, such as VELCRO. In another example, the tongue 110 can be attached to the inside of the toe portion 120 of the upper 104 using a hook and loop closure, such as VELCRO.

The lacing system 108 of the upper 104 includes a lace 112 that extends over the tongue 110 and through apertures 122 formed in the lateral side 114 and medial side 116 of the upper 104. The apertures may be loops, holes, slots and the like. In one arrangement, the apertures are loops. The loops can overhang the tongue. The tongue 110 extends under the lace 112 to separate the lace 112 from the instep area of the foot. The tongue can reduce the stress concentration of the laces and can prevent the laces from biting into the foot of the wearer.

In addition to apertures 122 being formed on the upper 104, additional apertures 122 can be formed on the tongue 110 and/or the heel portion 118 of the upper 104. The apertures may be holes, loops, slots or any suitable device for securing and guiding a lace. The lace 112 can extend through these apertures 122 to secure the tongue 110 in a floating position when the tongue 110 is not secured via the attachment feature or to assist retention of the tongue 110 in a fixed position when it is secured via the attachment feature 138. The lace 112 can include any suitable structure for securing the shoe 100. For example, the lace 112 may be a woven string made of natural or synthetic fibers, a flat, wide ribbon, a leather string, and the like.

By increasing the tension in the lace 112, the tension in the lateral side 114 and medial side 116 may be increased so as to draw the lateral side 114 and medial side 116 into contact with the foot. Similarly, by decreasing the tension in the lace 112, the tension in the lateral side 114 and medial side 116 may be decreased so as to provide additional volume for the foot within the upper 104. This general configuration provides a mechanism for adjusting the fit of the upper 104 and for accommodating various foot dimensions. The removable tongue can allow the upper to be expanded to a greater volume than that of a shoe having a permanently attached tongue. This can accommodate a larger variety of foot dimensions and allow the shoe to be converted to a dance shoe. With the tongue removed in this dance shoe configuration, the foot may be better able to arch through the opening during various movements.

A variety of materials are suitable to form the upper 104. For example, the upper 104 can be formed from combinations of leather, synthetic leather, natural or synthetic textiles, polymer sheets, polymer foams, mesh textiles, felts, non-woven polymers or rubber materials. The upper 104 can be formed from multiple layers with materials for each of the layers being chosen for varying characteristics including breathability, durability, flexibility, and the like. The various layers can be joined with an adhesive, and stitching may be used to join elements within a single layer or reinforce specific areas of the upper 104.

The tongue 110 may be made of a material similar to that of the upper 104. For example, the tongue 110 may include several layers of material, adhesively bonded or stitched together. The material for the tongue 110 may be chosen to maximize the comfort of the user or to maximize breathability. A number of other factors may also be considered when choosing the material for the tongue 110, such as those mentioned above. In addition, the tongue material may be chosen based on environmental conditions. For instance, the shoe may include a plurality of tongues. One tongue may be formed of a lightweight material, for warm weather conditions. In the alternative, one tongue may be formed of an insulated material for cold weather conditions. The tongue chosen may be based on such environmental conditions or on the comfort and performance preferences of the user. The additional tongues may be sold as part of the shoe or as an additional purchase.

Referring to FIG. 1B, the shoe 100 is shown with the lower portion of the leg of the user 124 visible and protruding from the cavity 106 of the shoe 100. The shoe 100 is shown in a street shoe configuration. It includes a sole 102 and an upper 104 having a tongue 110 and lacing system 108, as well as an elastic heel support 105. The lacing system 108 shown includes apertures 122 through which a lace 112 can extend on the lateral side 114 of the upper 104 and the medial side 116 of the upper 104.

Additional apertures 122 can also be formed on the tongue 110. These apertures 122 may provide an additional feature for securing the tongue 110 in the proper position for a comfortable fit. In addition, these apertures 122 can act to hold the tongue 110 in place when the tongue 110 is not attached to the upper 104 but rather is free floating.

FIG. 1B depicts the lacing system 108 using a standard shoe lace. Other aspects of the invention include a ribbon being utilized in the lacing system 108 in order to secure the shoe to the user's foot, as seen in FIG. 2.

The shoe 100 as configured in FIG. 1B may be worn as a typical street shoe. In addition, it may be worn for dance, or dance-related activities, utilizing a shoe configured for modern types of dance. The shoe 100 can be worn with the tongue removed, as a more traditional dance shoe, as shown in FIG. 2.

Figure 2:
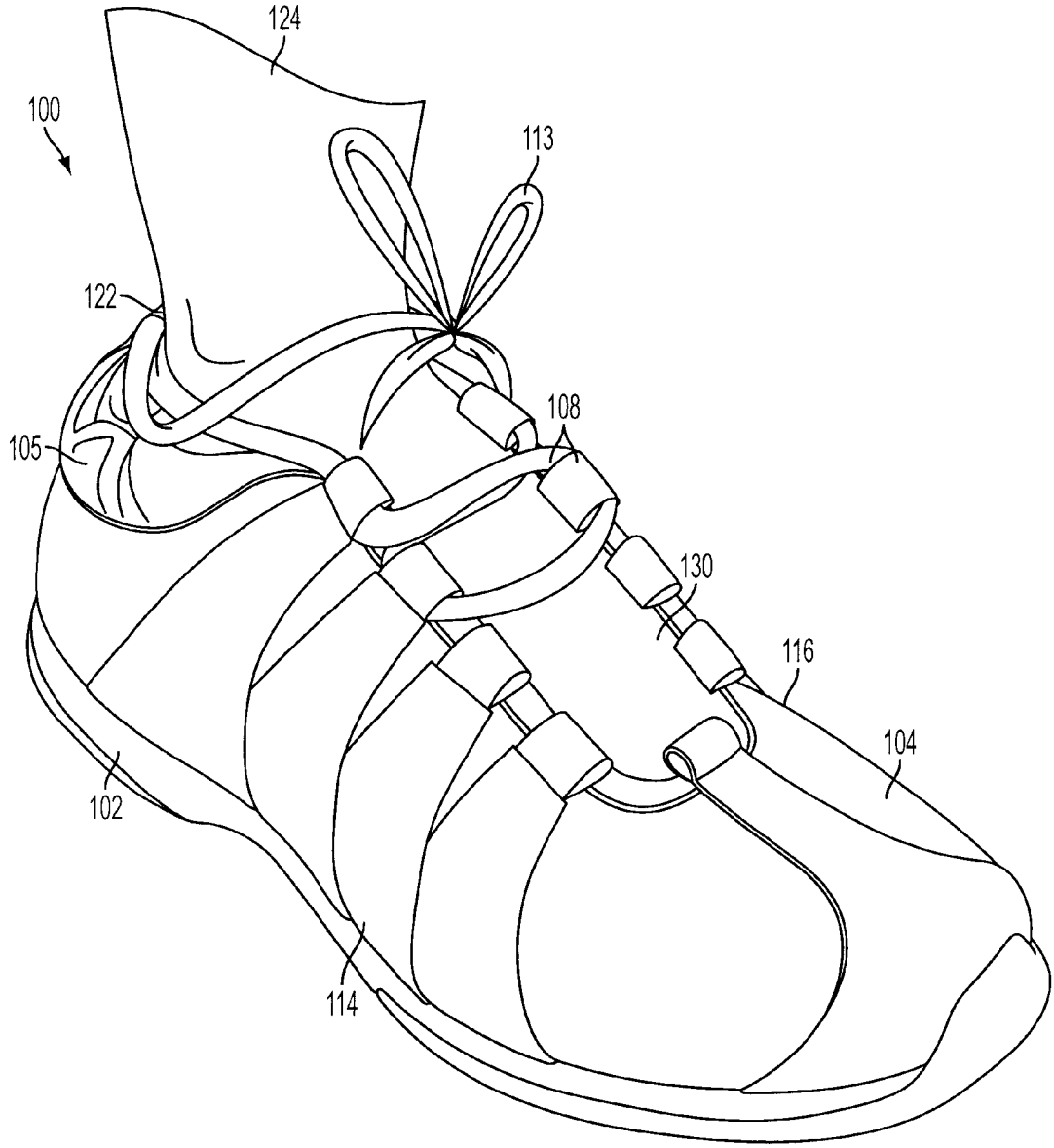
FIG. 2 is an alternate configuration of the shoe of FIG. 1B.

FIG. 2 depicts the shoe 100 of FIG. 1B in a dance shoe configuration. Again, the sole 102 and upper 104 having a lacing system 108, are visible. However, the tongue 110 shown in FIG. 1B has been removed. The user's foot 130 is visible between the lateral side 114 and medial side 116 of the upper 104. The ankle of the wearer extends out from the shoe 100 and is surrounded by elastic heel support 105.

The lacing system 108 of the upper 104 can include loops through which a dance ribbon 113 can extend. The dance ribbon can be flatter than a conventional lace and can include any suitable ribbon with a length longer than its width. In addition, the loops can overhang the open area where the tongue has been removed in order to minimize the amount of ribbon that is in contact with the shoe to prevent any discomfort. This configuration of the shoe 100 provides the appearance of a dance shoe. In addition, the ribbon 113 is strung through an aperture 122 on the heel portion 118 of the upper 104. That additional aperture 122 is included to allow the user to run a ribbon 113 through the aperture 122 and then tie the ribbon 113 around the ankle of the user. This provides the appearance of a traditional dance shoe but with the convenience of not having to remove the user's street shoe. In addition, this configuration can allow for more flexibility in the shoe and provides room for the top of the foot to arch during certain dance movements.

Figure 3:
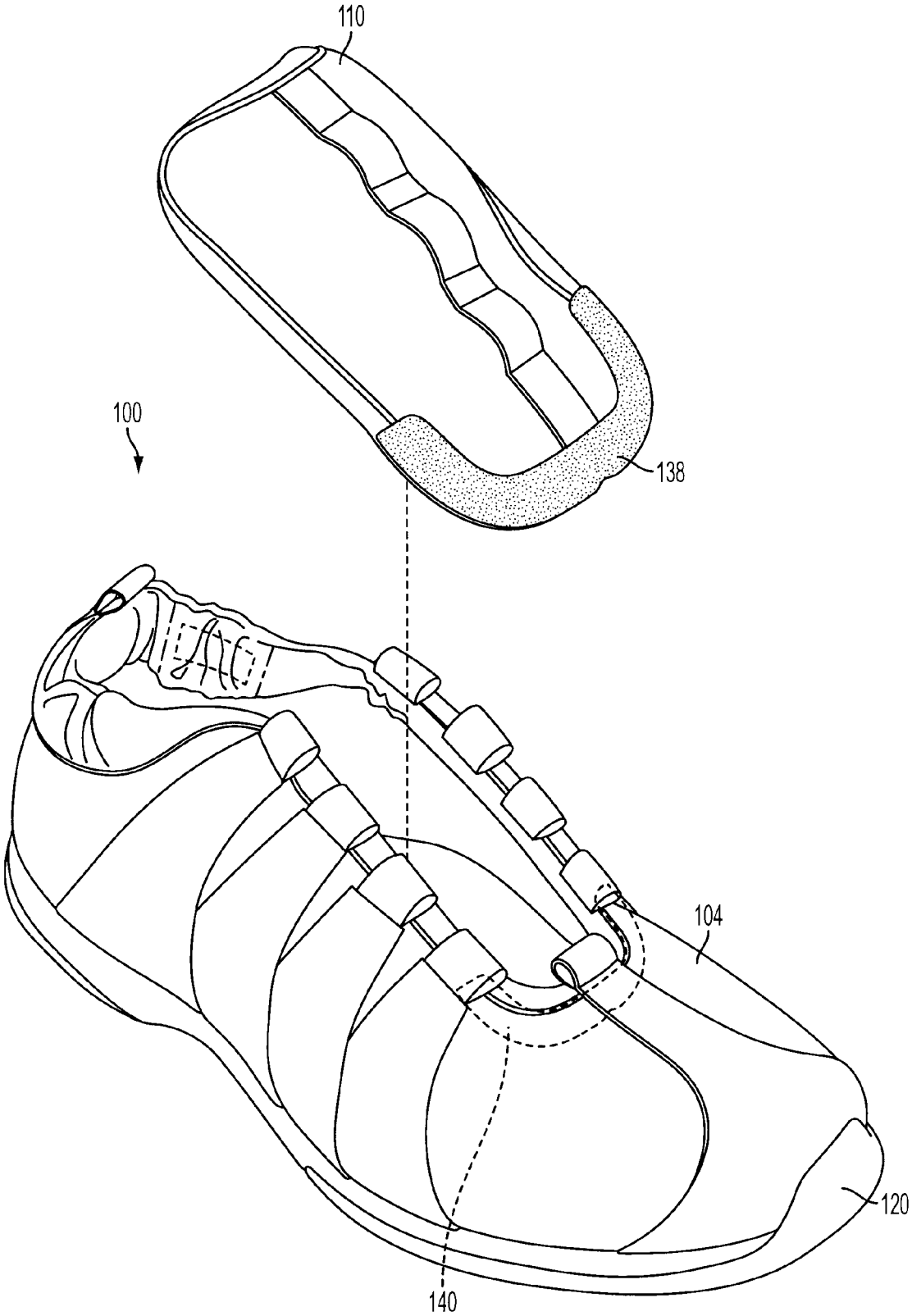
FIG. 3 is an exploded view of the shoe of FIG. 1A, which illustrates a removable tongue aspect of shoe of FIG. 1A.

FIG. 3 depicts the removably attached tongue 110 as it appears removed from the shoe 100. The tongue 110 is shown detached from the upper 104 of the shoe 100. The attachment feature 138 is seen at the bottom of the tongue 110. This attachment feature 138 may be any type of attachment feature 138 allowing the tongue 110 to be removed. For instance, the attachment feature 138 can be a hook and loop fastender, such as VELCRO, buttons, snaps, adhesive tape, and the like. However, the use of VELCRO is preferable for its ease of assembly and disassembly. In addition, VELCRO is preferable for its resistance to shear, which will prevent the tongue, when attached, from sliding laterally within the upper.

The mating surface 140 for the attachment feature 138 may be located on the inside surface of the upper 104. The mating surface 140 for the attachment feature 138 of the tongue 110 in FIG. 3 can be seen on the inside of the upper 104. The tongue 110, seen as removed in FIG. 3, can be inserted into the upper 104 and attached at the mating surface 140 of the attachment feature 138 on the inside of the toe portion 120 of the upper 104. To remove the tongue, the attachment feature 138 of the tongue may be unfastened from the mating surface 140. For instance, if the tongue is removably attached with VELCRO, the tongue may be peeled back from the mating surface. The attachment feature 138 allows the tongue 110 to be removed to convert the street shoe to a dance shoe.

Figure 4:
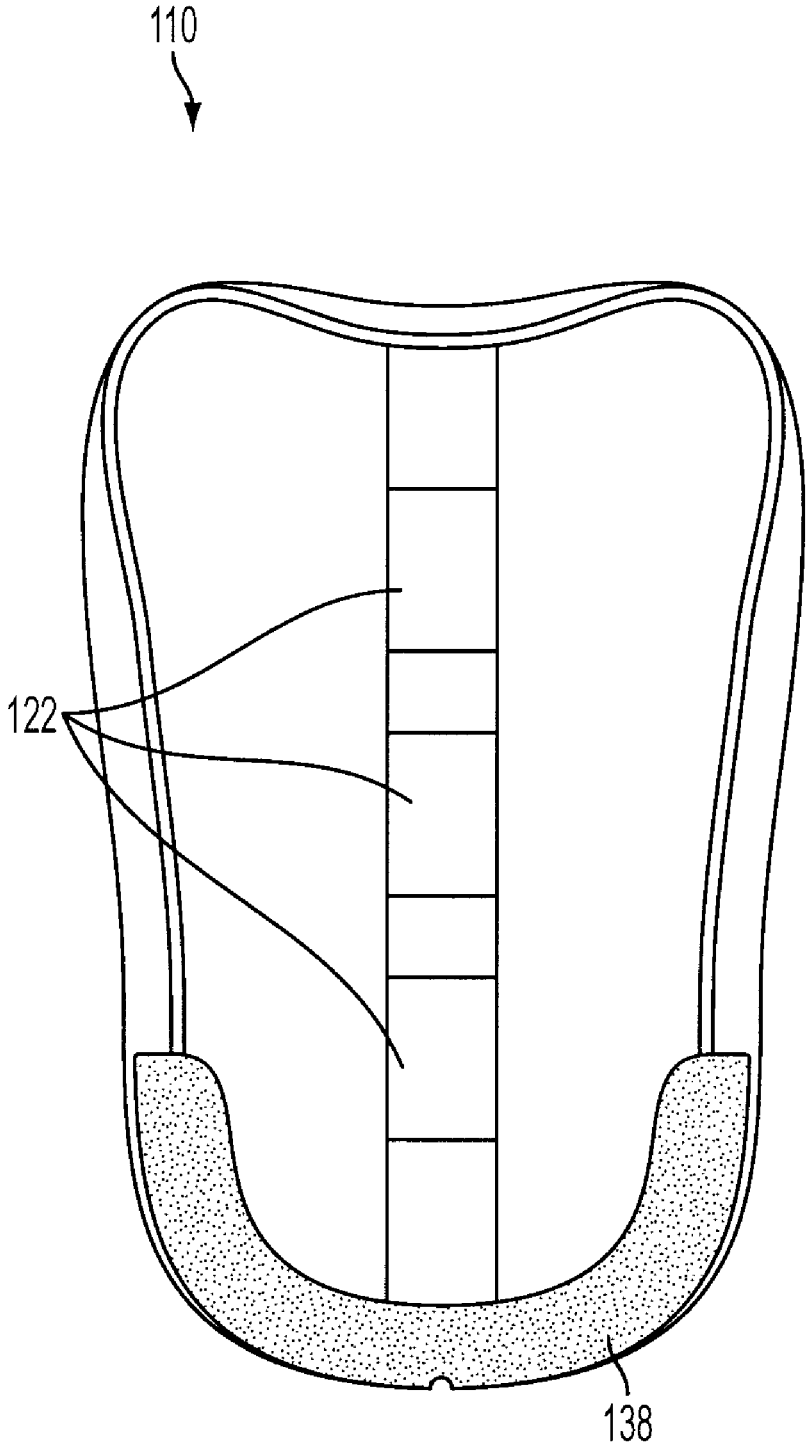
FIG. 4 is a top view of the removable tongue portion of the shoe of FIG. 1A.

FIG. 4 shows the top of the tongue 110 of FIG. 3 as it appears removed from the shoe. The attachment feature 138 is seen at the bottom of the tongue 110. In addition, apertures 122 can also be seen. Such apertures 122 are formed in the tongue 110 and through which a lace (not shown—112 in FIG. 1A) can be extended. The lace can be extended through these apertures 122 when the shoe is configured as a street shoe to provide additional support and ensure proper positioning of the tongue 110.

The removably attached tongue 110 can be removed by detaching it from the mating surface 140 of the attachment feature located on the inside surface of the upper 104. For example, the tongue may be attached using VELCRO. One side of the VELCRO attachment can be on the tongue, while the mating portion can be located on the inside of the upper. To remove the tongue, the tongue may be pulled or peeled away from the mating side of the attachment feature. In the same example, to reattach the tongue, the user can slide the tongue into position in the upper and press the VELCRO of the tongue into the mating attachment feature on the inside of the upper.

The removably attached tongue allows a user the convenience of converting the shoe from a street shoe to a dance shoe. For instance, the user can wear the shoe to a dance studio, as a conventional street shoe. In that configuration, the shoe may also be worn for dance, or dance-related activities, that can involve the use of a conventional street shoe. As the user desires a shoe having the appearance and functionality of a dance shoe, the shoe can be converted from a street shoe to a dance shoe by removing the conventional shoe lace extending through the lacing system and removing the tongue. A ribbon can be strung through the lacing system to provide the appearance of a dance shoe and fasten the shoe to the foot of the user. The ribbon can be fastened around the ankle of the user to provide additional support and continue the appearance of a dance shoe. The removal of the tongue accommodates the flex of the foot when performing various dance movements, such as curling the bottom of the foot, as in ballet.

Figure 5:
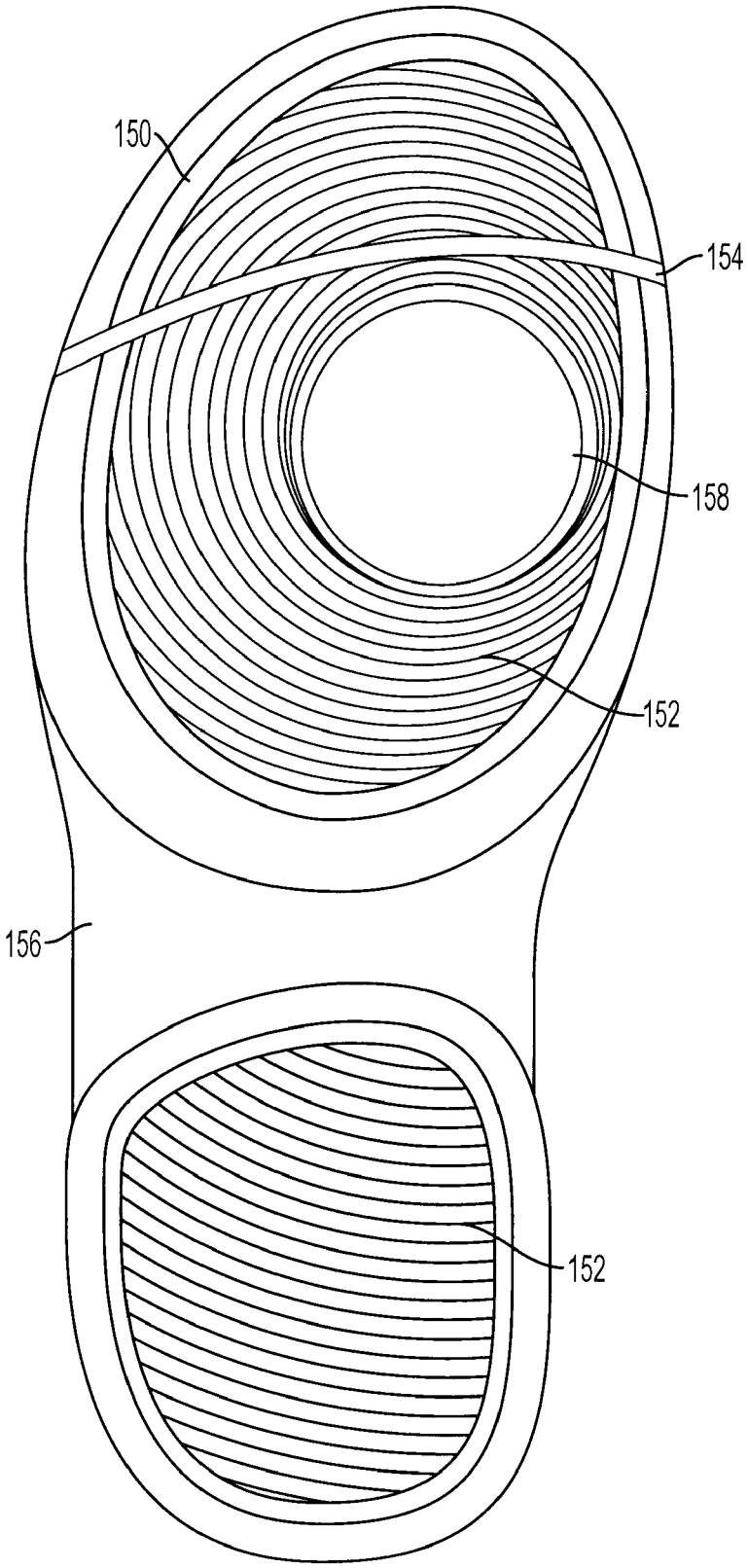
FIG. 5 is a bottom view of the outsole of the shoe of FIG. 1A.

FIG. 5 shows the outsole 150 of the shoe 100. The outsole 150 is configured with multi-directional tread 152 to provide traction when the shoe 100 is configured as a street shoe. When the shoe 100 is configured as a dance shoe, the sole 102 provides flexibility to accommodate various foot movements associated with dance or dance-related activities. A flex groove 154 can be formed in the sole to provide flexibility in the toe portion of the sole. Additional flexibility is provided in the area 156 bridging the tread portions 152. This flexible area 156 allows the foot to accommodate various dance and dance-related movements, such as curling the bottom of the foot. In addition, the outsole include a pivot pad 158 or spin pad that may have a lower coefficient of friction that the rest of the outsole. This pivot pad 158 can allow the dancer to turn or spin on that area with relative ease.

Figure 6:
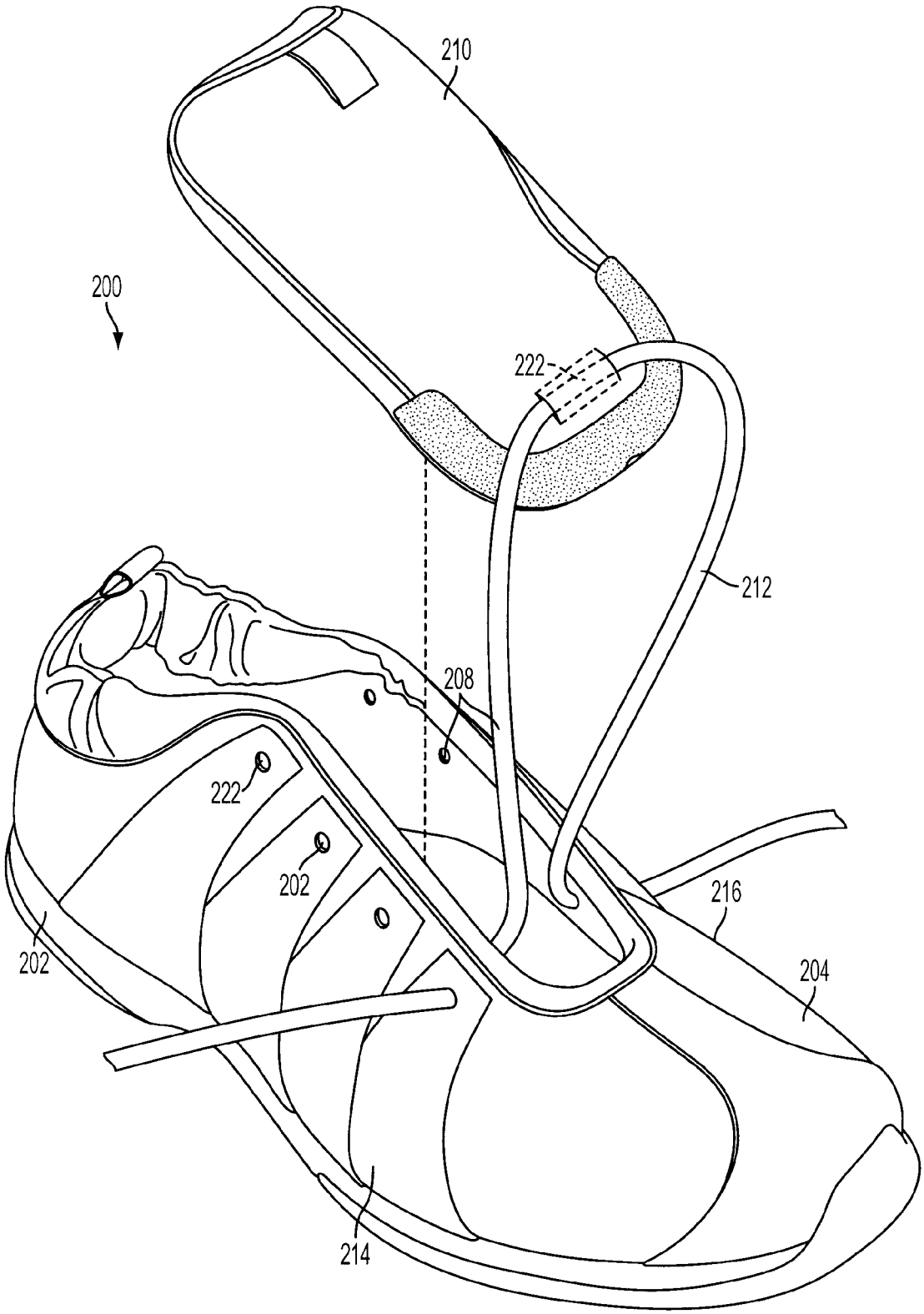
FIG. 6 is a perspective view of another arrangement of a shoe according to aspects of the convertible dance shoe.
Figure 7:
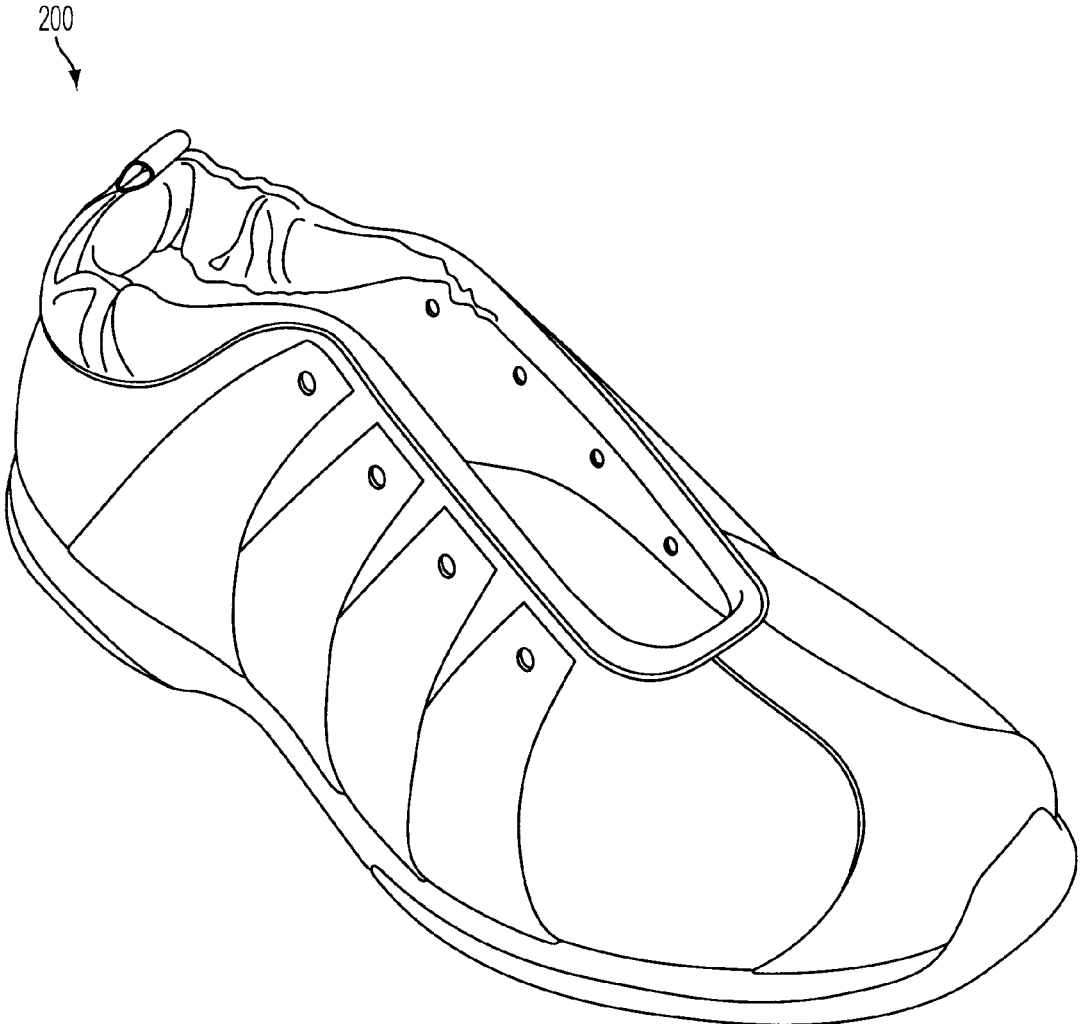
FIG. 7 is a perspective view of the shoe of FIG. 6 shown with the removable tongue portion removed.
Figure 8:
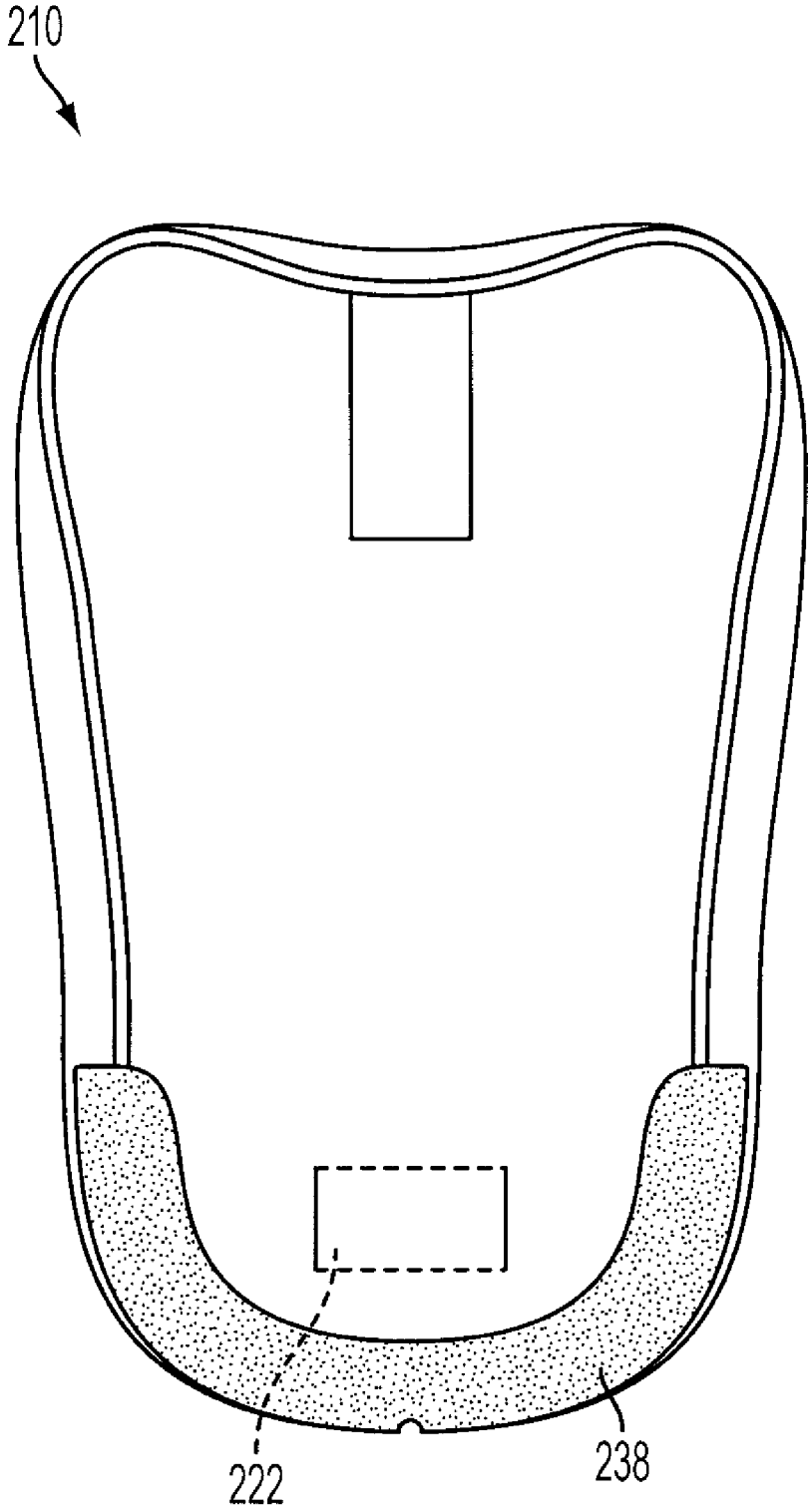
FIG. 8 is a top view of the removable tongue of the shoe of FIG. 6.

A second arrangement of a convertible dance shoe is shown in FIGS. 6-8. FIG. 6 shows a convertible dance shoe 200 showing aspects of this second embodiment. The shoe 200 of FIG. 6 includes a sole 202, as well as an upper 204 including a tongue 210 and a lacing system 208. Aspects of this embodiment include apertures 222 on the tongue 210 through which a lace 212 may be extended. For example, in lieu of attaching the tongue 210 to the upper 204 via the attachment means, the tongue 210 may be generally free floating and yet held in position by the lace 212.

The lace 212 may be threaded through the apertures 222 on the lateral side 214 and medial side 216 of the upper 204 and also through the aperture 222 formed on the tongue 210. The apertures 222 on the upper 204 in FIGS. 6-8 are shown as holes, however the apertures 222 may also be slots, loops or any suitable lace holding device. The aperture 222 on the tongue 210 is a slot type aperture 222 to allow the laces 212 to slide through. This allows unrestricted width adjustment and longitudinal placement of the tongue 210. This adjustability can enhance fit and comfort characteristics of the shoe 200.

As seen in FIG. 7, the tongue 210 (not shown) can be completely removed from the shoe 200, allowing it to function as a dance shoe. As shown, the tongue 210 has been removed from the mating surface of the attachment feature (not shown). This removal may be by pulling the tongue 210 or peeling it away from the mating side of the attachment feature. The lace can also be removed, as seen in FIG. 7. The lace may be replaced with a ribbon or another type of string that may be generally used with a dance shoe.

FIG. 8 depicts the tongue 210 of the shoe 200 of this embodiment. The attachment feature 238 is seen at the bottom of the tongue 210. The attachment feature 238 may be any suitable attachment device, such as VELCRO®, snaps, buttons, adhesive tape, and the like. In addition, the aperture 222 through which a lace can extend is visible. The lace may extend through the apertures 222 on the tongue 210 to secure the tongue 210 in the desired position within the upper 204.

The removable tongue 210 can be secured to the shoe 200 via the lacing system 208. For instance, a lace or other lacing device may extend through the aperture 222 or slot on the tongue 210. The tongue 210 can freely slide along the lace allowing unrestricted width adjustment. This floating tongue 210 can be positioned to enhance comfort and fit characteristics of the shoe. For example, when a conventional lace, or another rounded type of lace, is used in the lacing system 208, the floating tongue 210 can prevent the lace from biting into the foot of the user. In addition, the floating tongue 210 configuration can allow the tongue to move independent of the upper or to remain unaffected by the movement of the upper.

In addition, the free floating tongue 210 can be positioned longitudinally. For example, the tongue can be moved either up or down along the top of the foot and secured in that position via the portion of the lace closest to that position. This longitudinal movement provides enhanced comfort and fit for the user.

The floating tongue arrangement can also enhance the comfort of the shoe by allowing the tongue to move within the upper. For instance, the tongue can slide into and out of the upper, or can move toward the lateral or medial side within the upper. As the tongue slides within the upper, the upper remains stationary. The capability of the tongue to slide beneath the upper can prevent bunching or creasing of the tongue, which can cause discomfort to the user.

Figure 9:
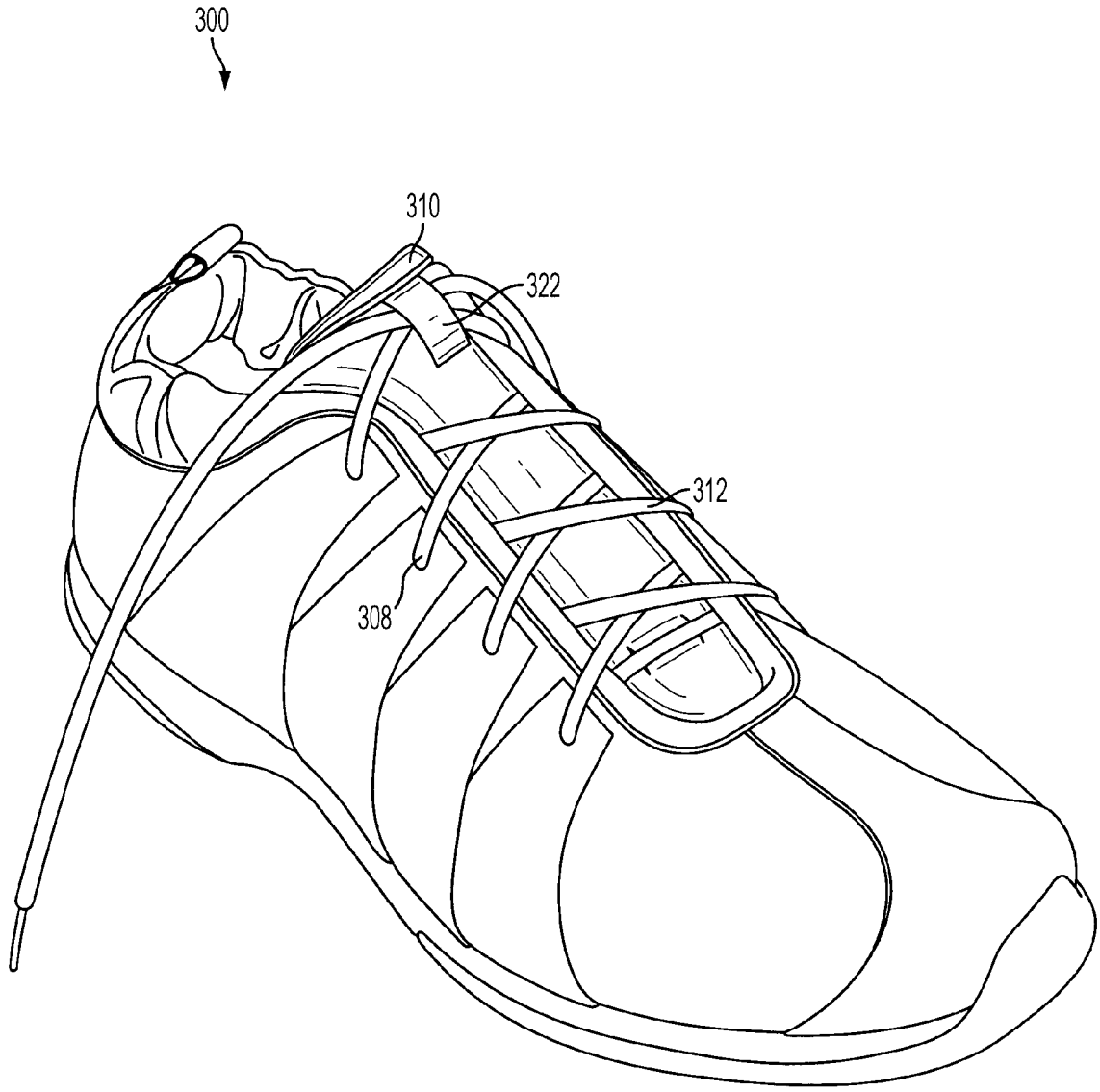
FIG. 9 is a perspective view of another configuration of the shoe of FIG. 6 including a floating tongue portion.

FIG. 9 depicts a shoe 300 according to an alternate configuration of the second arrangement shown in FIGS. 6-8. The tongue 310 of this configuration includes an aperture 322 at the top. In one example, the aperture 322 is slot at the top. This slot 322 can receive a lace 312 which secures the tongue 310 in a position. The tongue 310 is free floating, except for the lace 312 strung through the slot 322. This free floating tongue 310 allows for easier removal of the tongue 310 to convert the shoe 300 from a street shoe to a dance shoe. It also allows for movement of the tongue 310 to enhance comfort and fit characteristics of the shoe 300. For example, when a conventional lace, or another rounded type of lace, is used in the lacing system 308, the floating tongue 310 can prevent the lace from biting into the foot of the user. In addition, the floating tongue 310 configuration can allow the tongue to move independent of the upper or to remain unaffected by the movement of the upper.

In addition, the convertible dance shoe can also be sold as a kit. With reference to FIGS. 1A-2, such kit can generally include a shoe 100, the removably attached tongue 110, a conventional lace 112 and a ribbon 113 for lacing the shoe as a dance shoe. The shoe 100 can then be converted from a street shoe configuration with the tongue 110 attached and a conventional lace for securing the shoe to the user's foot, to a dance shoe with the tongue 110 removed and a ribbon 113 for securing the shoe to the user's foot.

The convertible dance shoe has been described in terms of preferred and exemplary embodiments thereof. Numerous other embodiments, modifications and variations within the scope and spirit of the appended claims will occur to persons of ordinary skill in the art from a review of this disclosure.

We claim:

1. A convertible dance shoe, comprising:

a sole, including a midsole and an outsole, and having flexible regions, the flexible regions including a flex groove extending uninterrupted from an edge on a lateral side of the shoe to an edge on a medial side of the shoe, the flex groove providing flexibility to the convertible dance shoe in a downward direction in which a foot of a wearer curls, and a spin pad located on the outsole and having a lower coefficient of friction than a remainder of the outsole; and an upper including a tongue and a lacing system having loops at a top portion of the upper, the tongue being removably attachable to and detachable from the upper via an attachment feature to allow for conversion between a street shoe configuration and a dance shoe configuration.

2. The convertible dance shoe of claim 1, wherein the spin pad is located near the ball of the foot.

3. The convertible dance shoe of claim 2, wherein the attachment feature is a hook and loop type fastener.

4. The convertible dance shoe of claim 1, wherein the flexible regions include a flex groove.

5. The convertible dance shoe of claim 4, wherein the flex groove is across a toe portion of the outsole.

6. The convertible dance shoe of claim 1, further comprising an elastic heel support around a lower portion of an ankle of a wearer.

7. The convertible dance shoe of claim 1, further including a loop at a heel portion of the upper, through which a lace may extend.

8. The convertible dance shoe of claim 7, wherein the lace is a dance ribbon.

9. The convertible dance shoe of claim 1, wherein the tongue may be detached from the upper and secured by a lace.

10. A kit for converting a street shoe to a dance shoe, the kit comprising:

a shoe, including a sole and an upper, the sole including at least one flex groove extending uninterrupted from an edge on a lateral side of the shoe to an edge on a medial side of the shoe, the flex groove providing flexiblity to the convertible dance shoe in a downward direction in which a foot of a wearer curls, and the upper including a lacing system having loops at a top portion of the upper;

a tongue, the tongue being removably attached to the upper;

a lace to secure the shoe to a user's foot when the shoe is configured as a street shoe; and a dance ribbon for securing the shoe to the user's foot when the shoe is configured as a dance shoe.

11. The kit of claim 10, wherein the sole further comprises a spin pad formed in the sole.

12. The kit of claim 10, wherein the sole further comprises at least one flex groove formed within the sole of the shoe.

13. The convertible dance shoe of claim 1, the outsole further including a region of multi-directional tread.

14. The convertible dance shoe of claim 13, wherein the flex groove is formed in the region of multi-directional tread and is separate from the multi-directional tread.

* * * * *